United States Patent [19]

Tagoku

[11] Patent Number: 4,556,311

[45] Date of Patent: Dec. 3, 1985

[54] ELECTROPHOTOGRAPHIC COPYING APPARATUS

[75] Inventor: Izumi Tagoku, Machida, Japan

[73] Assignee: Ricoh Company, Ltd., Tokyo, Japan

[21] Appl. No.: 520,188

[22] Filed: Aug. 4, 1983

[30] Foreign Application Priority Data

Aug. 5, 1982 [JP] Japan ..... 57-118288[U]

[51] Int. Cl.[4] ..... G03G 15/00

[52] U.S. Cl. ..... 355/14 R; 355/3 BE; 355/3 R; 355/16

[58] Field of Search ..... 355/14 R, 14 C, 3 R, 355/16, 3 DR, 55, 56

[56] References Cited

U.S. PATENT DOCUMENTS

| | | | |
|---|---|---|---|
| 3,912,390 | 10/1975 | Van Herten | 355/16 X |
| 4,025,180 | 5/1977 | Kurita et al. | 355/16 X |
| 4,252,432 | 2/1981 | Ophey | 355/14 R |
| 4,303,332 | 12/1981 | Sakai | 355/14 R |

*Primary Examiner*—A. C. Prescott

*Attorney, Agent, or Firm*—Cooper, Dunham, Clark, Griffin & Moran

[57] ABSTRACT

An electrophotographic copying apparatus including a photosensitive member having an image forming surface large enough to form a plurality of sizes of images thereon, and control signal generating means located on the image forming surface of the photosensitive member for generating signals for controlling a plurality of image forming starting positions corresponding to a plurality of sizes of images or timing of other operations of the image forming process. The invention has particular utility in application to a copying apparatus having a photosensitive member large enough to form a plurality of image segments of at least one of the plurality of sizes of images on the image forming surface in the photosensitive member. The photosensitive member may be in the form of a photosensitive drum or a photosensitive endless belt with or without a joint. The control signal generating means may comprise optical marks detected by reflection type photoelectric sensors, marks in the form of irregularities detected by mechanical feelers or magnetic marks detected by magnetic sensors. When the images can be in a large number of sizes, binary signal generating means may advantageously be used as control signal generating means to generate binary signals which are combined with each other to represent image forming starting positions or effect control of other operations of the image forming process.

8 Claims, 3 Drawing Figures

ELECTROPHOTOGRAPHIC COPYING APPARATUS

BACKGROUND OF THE INVENTION

This invention relates to electrophotographic copying apparatus, and more particularly it is concerned with an electrophotographic copying apparatus capable of forming a plurality of sizes of images on the image forming surface of a photosensitive member.

In many types of electrophotographic copying apparatus, copying of a document can be performed in a plurality of sizes of images, and different sizes of images can be formed on the image forming surface of the photosensitive member. In electrophotographic copying apparatus of the prior art, it has hitherto been usual practice to start forming images from the same position irrespective of the sizes of the images formed. Thus when it is desired to form three different sizes of images or an image of A4 size (210 mm×297 mm), an image of B4 size (257 mm×364 mm) and an image of A3 size (297 mm×420 mm), for example, on the image forming surface of a photosensitive member having a size large enough to form two image segments of the A3 size, the number of image segments that could be formed on the entire area of the photosensitive member would be limited to two of any size or sizes.

Market researches have shown that even if an electrophotographic copying apparatus capable of producing copies of a large size, such as A3 size, is used, the majority of copying operations performed in offices and factories by using such apparatus are intended to produce copies of smaller sizes, such as A4 size, in actual practice.

When the photosensitive member is used in the manner described hereinabove, the major portion of the image forming surface of the photosensitive member would be wasted because only a small portion is actually used but also different portions of the image forming surface of the photosensitive member would show different degrees of fatigue because a portion of a certain length from the image forming starting position is used at all times, and damage caused to the image forming surface of the photosensitive member when transfer-prining sheets are separated therefrom, for example, would be concentrated in a specific portion and the service life of the photosensitive member would be greatly reduced.

SUMMARY OF THE INVENTION

This invention has been developed for the purpose of obviating the aforesaid disadvantages of the electrophotographic copying apparatus of the prior art capable of forming a plurality of sizes of copies. Accordingly, the invention has as its object the provision of an electrophotographic copying apparatus wherein a larger number of image segments can be formed when the images formed are small in size than when the images formed are large in size with respect to the entire area of the image forming surface of the photosensitive member, wherein the risk of different portions of the image forming surface showing different degrees of fatigue can be avoided by avoiding concentration of the image forming regions in a particular zone of the image forming surface, and wherein when the photosensitive member is in the form of a belt of a large length having a joint, the image forming regions on the image forming surface of the photosensitive member are prevented from including the joint.

DESCRIPTION OF THE PREFERRED EMBODIMENTS

Figure 1:
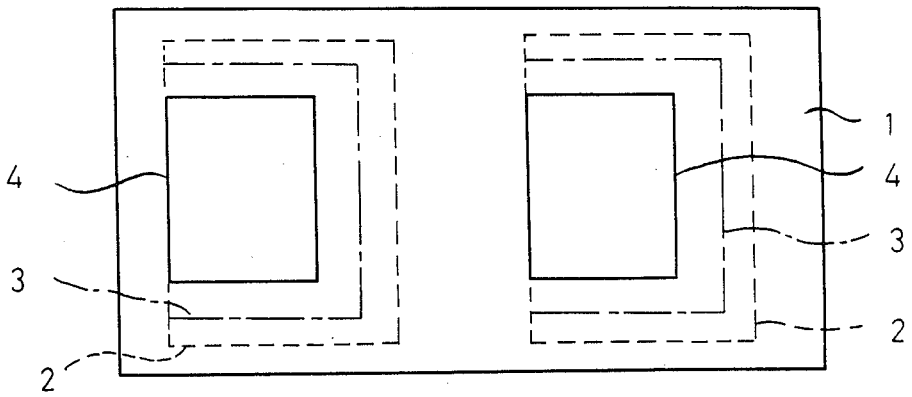
FIG. 1 PRIOR ART
FIG. 1 is a developed view of a photosensitive member of an electrophotographic copying apparatus of the prior art, showing the arrangement of image forming segments on the image forming surface of the photosensitive member.

The invention will now be described in detail by referring to its embodiments shown in the drawings.

FIG. 1 shows one example of the image forming surface of a photosensitive member of the prior art large enough to form two image segments of A3 size, in which images of three different sizes, or A4, B4 and A3, are formed by using the same position as an image forming starting position, as described in the background of the invention. The numeral 1 designates an image forming surface of a photosensitive member on which 2, 3 and 4 designate an image segment of A3 size in broken lines, an image segment of B4 size in dash-and-dot lines and an image segment of A4 size in solid lines respectively.

Figure 2:
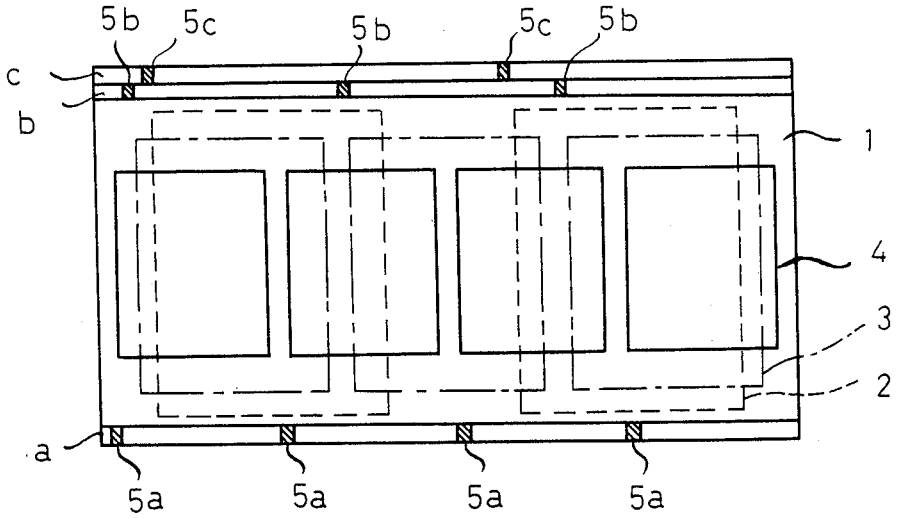
FIG. 2 is a developed view of the photosensitive member of an electrophotographic copying apparatus comprising one embodiment of the invention.

FIG. 2 shows the image forming surface of a photosensitive member, which may be in the form of a drum or an endless belt, of one example of the electrophotographic copying apparatus in conformity with the invention. The figure is a developed view cut in a position which may vary depending on whether or not the photosensitive member has a joint. When the photosensitive member has a joint, the position is where there is one of the joint and when there are no joint, the position may be arbitrarily selected. Like FIG. 1, FIG. 2 shows image forming positions of A3 size, B4 size and A4 size in broken lines 2, dash-and-dot lines 3 and solid lines 4 respectively. As can be clearly seen in the figure, the image segments (the maximum number for each size) that can be formed are arranged equidistantly with respect to the total length of the image forming surface 1, of the photosensitive member (when the photosensitive member has a joint, the length of a space between the joint). By arranging the image forming segments in this way, it is possible to form images in such a manner that the images of A3 size, B4 size and A4 size have two segments, three segments and four segments respectively.

By varying the image forming starting position and the number of image segments formed on the image forming surface 1 of the photosensitive member in accordance with the image sizes as described hereinabove, it is possible to increase the number of image segments formed on the image forming surface 1 when the copies to be produced are small in size and consequently the number of copies produced for one run of the photosensitive member or the copying speed (the number of copies produced per unit time) can be increased. Also fatigue of the material of the photosensitive member and damage to the image forming surface thereof can be spread uniformly over the entire zone of the image forming surface, resulting in a prolonged service life of the photosensitive member. When the photosensitive member has joints, the new arrangement can prevent the inclusion of such joints in the image forming segments.

To effect control of the image forming starting time or timing of other operations of the image forming process when images are formed by varying the image forming starting position and the number of image segments formed on the image forming surface of the photosensitive member in accordance with the image sizes, control signal generating marks 5*a*, 5*b* and 5*c* for generating signals for controlling the image forming starting time or timing of other operations of the image forming process are set in tracks a, b and c for different sizes of images respectively. The tracks a, b and c correspond to the sizes A4, B4 and A3 respectively. Sensors are provided to the copying apparatus corresponding to the tracks a, b and c in which the control signal generating marks are set.

The control signal generating marks 5*a*, 5*b* and 5*c* may be in the form of optical marks having a reflection factor different from that of the image forming surface 1 of the photosensitive member, and the sensors may be in the form of reflection type photoelectric sensors. However, the invention is not limited to these specific marks and sensors and other combinations of marks and sensing means known in the art may be used. For example, cutouts, recesses or irregularities may be formed on the image forming surface of the photosensitive member and these marks may be detected by mechanical feelers to actuate microswitches or the marks may be formed of a magnetic material and sensed by magnetic sensing means, such as Hall elements.

A copying operation performed by the embodiment of the photoelectric copying apparatus in conformity with the invention will be described. The size of images to be formed on the image forming surface 1 of the photosensitive member is detected as by sheet size sensing means for sensing sheet sizes (A4, B4, A3 etc.) of sheets supplied from a sheet feeding cassette. As a copying button is depressed, the photosensitive member begins operating and one of the control signal generating marks 5*a*, 5*b* and 5*c* is sensed by a corresponding sensor. Thus a copying operation is initiated at a point in time when a copy sheet size signal sensed by the sheet size sensing means and an image forming starting position signal generated by the sensor for the particular image forming starting position sensing mark agree with each other. Thus charging of the image forming surface 1 of the photosensitive member, exposing of the image forming surface to an optical image of a document to be copied, scanning, developing, sheet feeding and transferprining are performed in a controlled manner by using the aforesaid point in time as a starting point in accordance with a predetermined program.

In the embodiment shown and described hereinabove, the image forming surface of the photosensitive member has been described as being formed at its edge portion with tracks for setting control signal generating marks corresponding in number to the sizes of images to be formed and the copying apparatus has been described as being provided with sensors of the same number as the image sizes, so as to determine the image forming starting position for each image size. However, the number of mark setting tracks should be increased as the number of image sizes increases, and the width of the photosensitive member would have to be increased in spite of the width of the images actually formed not increasing. The number of the sensors would have to be increased correspondingly.

To avoid the aforesaid disadvantage, binary signal generating means may be used for generating image forming starting position control signals corresponding to the sizes of images to be formed.

Figure 3:
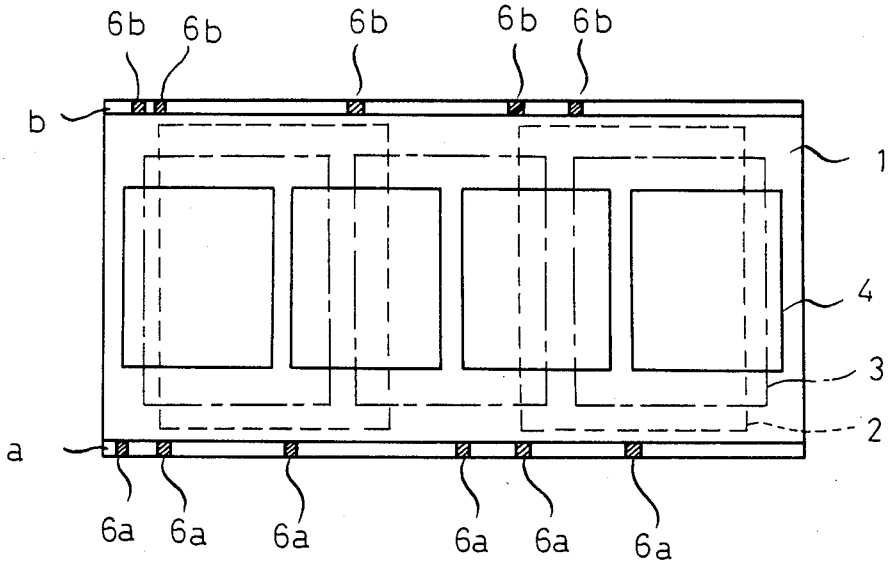
FIG. 3 is a developed view of the photosensitive member of an electrophotographic copying apparatus comprising another embodiment.

FIG. 3 shows another embodiment of the invention in which the use of binary signal generating means is incorporated. As shown, image forming segments 2, 3 and 4, corresponding to image sizes A4, B4 and A3, are distributed over the entire length of the image forming surface 1 (when the photosensitive member has joints, over the length of the space between the joint), in the same manner as the image forming segments are distributed over the image forming surface 1 of the embodiment shown in FIG. 2. Tracks a and b for setting signal generating marks are formed each in one of opposite edge portions of the image forming surface 1 of the photosensitive member, and sensors each corresponding to one of the marks are provided in the copying apparatus. Marks shown in the table below are set in the tracks a and b in image forming starting positions for different sizes of images (0 designates the presence of marks).

| Image Size | Track a | Track b |
|---|---|---|
| A4 | 0 | — |
| B4 | — | 0 |
| A3 | 0 | 0 |

The marks and the sensors for detecting the marks may be in the form of optical marks having a refrection factor different from that of the image forming surface 1 of the photosensitive member and in the form of reflection type photoelectric sensors respectively, as is the case with the embodiment shown in FIG. 2. A combination of cutouts or irregularities and microswitches having mechanical feelers, or a combination of magnetic marks and magnetic sensors, may be used instead.

Whatever the marks and the sensors may be, the main thing is that a signal of "1" or "0" is produced when one of the sensors detects the presence of an associated one of the marks. By combining the binary signals produced by the sensors, it is possible to generate the following four combination signals:

| Sensor a | Sensor b | Combination Signal |
|---|---|---|
| 0 | 0 | Not imgage forming starting position. |
| 1 | 0 | A4 size image forming starting position. |
| 0 | 1 | B4 size image forming starting position. |
| 1 | 1 | A3 size image forming starting position. |

Each sensor only has to produce a binary signal "1" or "0" or the sensors only have to detect the presence or absence of the marks. There is no risk of the sensors misoperating even if the marks are soiled by the toner or damaged during printing operations. Needless to say, an AND gate circuit may be used as a circuit for producing signals each consisting of binary signals combined with each other. When two binary signals produced by sensing the marks are combined with each other, four combination signals can be produced as described hereinabove. However, a combination signal "0.0" does not represent an image forming starting position, so that it is possible to produce three combination signals representing three image forming starting positions in this embodiment.

Generally when two binary signals are combined with each other to produce combination signals representing different sizes, the following relation holds between the number n of the sensing means and the number of sizes N to be represented:

$$N=2^n-1.$$

Thus when there are three sensing means, it is possible to produce seven combination signals representing seven different sizes. An increase in the number of sizes that can be represented by combination signals would be advantageous.

From the foregoing description, it will be appreciated that in the electrophotographic copying apparatus incorporating the invention, the image forming surface of the photosensitive member can be utilized in its entire length without leaving any portion thereof unused, so that it is possible to increase the copying speed when copies of small sizes are produced and the service life of the photosensitive member can be prolonged because local fatigue and concentration of damage in one portion of the photosensitive member can be avoided. The use of binary signal generating means for generating binary signals which are used in combination for representing image forming starting positions for different image sizes enables different types of control to be effected by using small number of sensing means. Even if the sensing means are located in positions on the surface of the photosensitive member in which the image forming surface is liable to be soiled or damaged, there is little risk of the sensing means misoperating.

What is claimed is:

1. An electrophotographic copying apparatus comprising:

a photosensitive member having an image forming surface on which a plurality of images of respective different sizes can be formed in the course of an image forming process and;

control signal generating means disposed on the image forming surface of the photosensitive member for generating signals for controlling the image forming process for each respective one of said plurality of images of respective different sizes, said respective control signal generating means being located at respective positions corresponding to the respective forward edges of the images of respective different sizes to be formed on the photosensitive member, and said respective control signal generating means for images of different image sizes being disposed at respective different positions determined by the respective different sizes of images, and on respective different tracks which are outside the region of said image forming surface on which images are formed in the course of said image forming process; and said signal generating means for each of said tracks being detectable by respective sensors.

2. An electrophotographic copying apparatus as in claim 1, wherein said photosensitive member is long enough to form thereon concurrently a plurality of images of at least one of said plurality of image sizes on its image forming surface.

3. An electrophotographic copying apparatus as in claim 1 or 2, wherein said photosensitive member comprises an endless belt photosensitive member.

4. An electrophotographic copying apparatus as in claim 1 or 2, wherein said photosensitive member comprises an endless belt photosensitive member having a joint.

5. An electrophotographic copying apparatus as in claim 1, wherein said control signal generating means comprise optical marks detectable by photoelectric sensors of the reflection type.

6. An electrophotographic copying apparatus as in claim 1, wherein said control signal generating means comprise irregularities marks detectable by mechanical feelers.

7. An electrophotographic copying apparatus as in claim 1, wherein said control signal generating means comprise magnetic marks detectable by magnetic sensors.

8. An electrophotographic copying apparatus as in claim 1, wherein said control signal generating means comprise binary signal generating means for generating binary signals which are combinable with each other into control signals each representing one of a plurality of image forming starting positions for effecting control of the image forming process.

* * * * *